US012716317B2

(12) United States Patent
Martin et al.

(10) Patent No.: US 12,716,317 B2
(45) Date of Patent: Aug. 25, 2026

(54) DOWNHOLE TOOL AND METHOD OF USE

(71) Applicant: The WellBoss Company, LLC, Houston, TX (US)

(72) Inventors: Carl Martin, Cypress, TX (US); Ryan Patrick Malone, Houston, TX (US)

(73) Assignee: The WellBoss Company, LLC, Houston, TX (US)

( * ) Notice: Subject to any disclaimer, the term of this patent is extended or adjusted under 35 U.S.C. 154(b) by 0 days.

(21) Appl. No.: 19/032,328

(22) Filed: Jan. 20, 2025

(65) Prior Publication Data

US 2025/0237118 A1 Jul. 24, 2025

Related U.S. Application Data

(60) Provisional application No. 63/623,976, filed on Jan. 23, 2024.

(51) Int. Cl.

| | |
|---|---|
| ***E21B 33/12*** | (2006.01) |
| ***E21B 23/06*** | (2006.01) |
| ***E21B 33/128*** | (2006.01) |
| ***E21B 34/06*** | (2006.01) |

(52) U.S. Cl.

CPC ..... *E21B 33/128* (2013.01); *E21B 23/06* (2013.01); *E21B 34/063* (2013.01)

(58) Field of Classification Search

CPC .. E21B 34/063; E21B 33/1285; E21B 33/128; E21B 23/06

See application file for complete search history.

(56) References Cited

U.S. PATENT DOCUMENTS

| | | | | |
|---|---|---|---|---|
| 5,146,992 | A | 9/1992 | Baugh | |
| 5,607,017 | A | 3/1997 | Owens et al. | |
| 6,257,331 | B1 * | 7/2001 | Blount | E21B 23/0414 166/123 |
| 7,350,582 | B2 | 4/2008 | McKeachnie et al. | |
| 8,459,347 | B2 | 6/2013 | Stout | |
| 8,505,632 | B2 | 8/2013 | Guerrero et al. | |
| 8,668,019 | B2 | 3/2014 | Casciaro | |
| 8,839,873 | B2 | 9/2014 | Johnson et al. | |
| 8,991,505 | B2 | 3/2015 | Fleckenstein et al. | |
| 9,033,060 | B2 | 5/2015 | Xu et al. | |
| 9,080,439 | B2 | 7/2015 | O'Malley et al. | |
| 9,428,986 | B2 | 8/2016 | Hern et al. | |
| 9,482,071 | B2 | 11/2016 | Carrejo et al. | |
| 9,512,695 | B2 | 12/2016 | Pabon et al. | |
| 9,556,704 | B2 | 1/2017 | Naedler et al. | |
| 9,574,415 | B2 | 2/2017 | Xu et al. | |
| 9,624,751 | B2 | 4/2017 | Hern et al. | |
| 9,835,003 | B2 | 12/2017 | Harris et al. | |
| 9,976,379 | B2 | 5/2018 | Schmidt et al. | |
| 10,000,991 | B2 | 6/2018 | Harris et al. | |

(Continued)

*Primary Examiner* — Yong-Suk (Philip) Ro

(74) *Attorney, Agent, or Firm* — Kearney, Mc Williams & Davis, PLLC; John M. DeBoer

(57) ABSTRACT

A downhole tool suitable for use in a wellbore, the tool having a cone or mandrel, a first sleeve, a first ring and a lower sleeve. The downhole tool includes the first sleeve and the first ring, or respective portions thereof, disposed around one end of the cone. After initial activation, the downhole tool is in a first set configuration whereby the lower sleeve is engaged with the expansion sleeve and the cone, leaving a remnant cone-sleeve component configured to move toward or engage a profile.

20 Claims, 5 Drawing Sheets

(56) References Cited

U.S. PATENT DOCUMENTS

| | | | | |
|---|---|---|---|---|
| 10,066,453 | B2 | 9/2018 | Silva | |
| 10,358,887 | B2 | 7/2019 | Wise et al. | |
| 10,364,629 | B2 | 7/2019 | Jacob et al. | |
| 10,487,625 | B2 | 11/2019 | Jacob | |
| 10,533,392 | B2 | 1/2020 | Walton et al. | |
| 10,738,563 | B2 | 8/2020 | Crow et al. | |
| 11,434,717 | B2 | 9/2022 | Jacob | |
| 2006/0124312 | A1 | 6/2006 | Rytlewski | |
| 2011/0056692 | A1 | 3/2011 | Lopez De et al. | |
| 2012/0085538 | A1 | 4/2012 | Guerrero et al. | |
| 2012/0168163 | A1 | 7/2012 | Bertoja et al. | |
| 2014/0041876 | A1 | 2/2014 | Fleckenstein et al. | |
| 2014/0202708 | A1 | 7/2014 | Jacob et al. | |
| 2016/0040492 | A1 | 2/2016 | Vinson et al. | |
| 2016/0186511 | A1 | 6/2016 | Coronado et al. | |
| 2018/0223627 | A1 | 8/2018 | Pabon | |
| 2019/0032444 | A1 | 1/2019 | Provost et al. | |
| 2019/0234175 | A1 | 8/2019 | Crow et al. | |
| 2020/0277838 | A1* | 9/2020 | Hern | E21B 23/0412 |
| 2020/0392808 | A1* | 12/2020 | Greenlee | E21B 33/134 |
| 2021/0277741 | A1 | 9/2021 | Xue et al. | |
| 2021/0381334 | A1* | 12/2021 | Goodman | E21B 33/128 |
| 2022/0243554 | A1* | 8/2022 | Slup | E21B 33/124 |
| 2022/0389789 | A1* | 12/2022 | Jacob | E21B 34/142 |

* cited by examiner

DOWNHOLE TOOL AND METHOD OF USE

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool that may be run into a wellbore and useable for wellbore isolation, and methods pertaining to the same. In particular embodiments, the downhole tool may have one or more components made of a dissolvable material, any of which may be composite- or metal-based. The downhole tool may have an (intermediate) activated or set position without having to engage a tubular or other side surface. The downhole tool may be moved to a final or completed set position as a result of engagement with the tubular or other side surface. The final or completed set position may occur without the use of a typical setting tool.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 112 (e.g., e-line, wireline, coiled tubing, etc.) and/or with setting tool 117, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

The setting tool 117 is incorporated into the workstring 112 along with the downhole tool 102. Examples of commercial setting tools include the Baker #10 and #20, and the 'Owens Go'. Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments. In these conditions, conventional tools, including those with compressible seal elements, may become ineffective from degradation. For example, the sealing element may melt, solidify, or otherwise lose elasticity, resulting in a loss the ability to form a seal barrier.

Before production operations may commence, conventional plugs typically require some kind of removal process, such as milling or drilling. Drilling typically entails drilling through the set plug, but in some instances the plug can be removed from the wellbore essentially intact (i.e., retrieval). A common problem with retrievable plugs is the accumulation of debris on the top of the plug, which may make it difficult or impossible to engage and remove the plug. Such debris accumulation may also adversely affect the relative movement of various parts within the plug. Furthermore, with current retrieving tools, jarring motions or friction against the well casing may cause accidental unlatching of the retrieving tool (resulting in the tools slipping further into the wellbore), or re-locking of the plug (due to activation of the plug anchor elements). Problems such as these often make it necessary to drill out a plug that was intended to be retrievable.

However, because plugs are required to withstand extreme downhole conditions, they are built for durability and toughness, which often makes the drill-through process difficult, time-consuming, and/or require considerable expertise. Even drillable plugs are typically constructed of a metal such as cast iron that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

Composite materials, such as filament wound materials, have enjoyed success in the frac industry because of easy-to-drill tendencies. The process of making filament wound materials is known in the art, and although subject to differences, typically entails a known process. However, even composite plugs require drilling, or often have one or more pieces of metal (sometimes hardened metal).

The use of plugs in a wellbore is not without other problems. It is naturally desirable to "flow back," i.e., from the formation to the surface, the injected fluid, or the formation fluid(s); however, this is not possible until the previously set tool or its blockage is removed. Removal of tools (or blockage) usually requires a well-intervention service for retrieval or drill-through, which is time consuming, costly, and adds a potential risk of wellbore damage.

The more metal parts used in the tool, the longer the drill-through operation takes. Because metallic components are harder to drill, such an operation may require additional trips into and out of the wellbore to replace worn out drill bits.

In the interest of cost-saving, materials that react under certain downhole conditions have been the subject of significant research in view of the potential offered to the oilfield industry. For example, such an advanced material that has an ability to degrade by mere response to a change in its surrounding is desirable because no, or limited, intervention would be necessary for removal or actuation to occur.

Such a material, essentially self-actuated by changes in its surrounding (e.g., the presence a specific fluid, a change in temperature, and/or a change in pressure, etc.) may potentially replace costly and complicated designs and may be most advantageous in situations where accessibility is limited or even considered to be impossible, which is the case in a downhole (subterranean) environment. However, these materials tend to be exotic, rendering related tools made of such materials undesirable as a result of high cost.

Conventional, and even modern, tools require an amount of materials and components that still result in a set tool being in excess of twelve inches. A shorter tool means less materials, less parts, reduced removal time, and easier to deploy.

The ability to save cost on materials and/or operational time (and those saving operational costs) leads to considerable competition in the marketplace. Achieving any ability to save time, or ultimately cost, leads to an immediate competitive advantage.

Frac plugs offered on the market currently are conventional in design, incorporating the aforementioned slips and sealing elements of some kind. This generally requires a number of parts that must be removed after the frac operation is compete, such as by dissolving or drilling. The larger the volume of material to dissolve or drill correlates to the total amount of time involved in removal. Also, some operators are growing weary of casing damage caused by conventional slips when they penetrate the casing when anchoring.

Another problem is when the wellbore diameter is larger. With a larger bore, a plugging tool needs to be more robust in order to properly seal and engage. Downhole pressure in larger bores tends to have higher propensity to cause seal extrusion or disengagement, resulting in loss of pressure integrity.

Accordingly, there are needs in the art for novel systems and methods for isolating wellbores in a fast, viable, and economical fashion. There is a great need in the art for downhole plugging tools that contain less materials, less parts, have reduced or eliminated removal time, and are easier to deploy, even in the presence of extreme wellbore conditions. There is also a need for a downhole tool made substantially of a drillable material that is easier and faster to drill, or outright eliminates a need for drill-thru.

A simpler design, with fewer parts, will have a competitive advantage. Using less material also translates into lower production cost, since the dissolving material cost is a greater percentage of the overall cost when compared to conventional composite plugs. A tool with fewer parts is cost effective, which is of greater significance in a depressed market. Embodiments herein provide for a downhole tool that is void of a slip, and thus casing damage that might otherwise occur from slip engagement is totally mitigated.

SUMMARY

Embodiments herein may provide for a downhole tool useful for oil and gas 'plug and perf' fracking operations. Plug and perf fracking has been around for decades and relies on plugs that are set at each stage to hold pressure throughout the fracking operation. Frack plug technology has evolved over time to improve reliability, lower cost, extend plug life reduce cleanout time and effort and most recently to dissolve completely without the need for follow up clean out.

Embodiments of the disclosure pertain to a downhole tool, or system or method of using the same, wherein at least one component of the downhole tool may be made of a dissolvable material. In operation, activation of the downhole tool in the wellbore results in expansion of a sleeve, but the downhole tool need not be anchored to a surround tubular after initial activation. Thereafter, a remnant mandrel-sleeve component engaged together may be configured to move or be moved to a desired position. The downhole tool may have a first activation configuration suitable as an intermediate or armed configuration. The downhole tool may have another or second configuration. There may be another or final (set) configuration.

The tool may be able to engage or seat on a profile (which may be pre-existing), and thereby form a plug in support of a fracturing operation once a ball or other plug device may be seated in the cone. The profile may be an increased and/or decreased diameter compared to that of the surrounding tubular. The downhole tool may be suitable to set within and accommodate drift diameter of the surrounding tubular.

Embodiments herein may pertain to a downhole tool, or system or method of using the same, that may have a cone (or mandrel). The cone may include a distal end; a proximate end; and an outer surface. The outer surface may be smooth and/or void of threads.

The downhole tool may include a sleeve, which may be an expandable or expansion sleeve. The sleeve may be movingly (slidingly) engaged with the outer surface. The tool may include a ring, which may be a load bearing ring. The bearing ring may be disposed around the cone, and also engaged with the outer surface. The bearing ring and the expansion sleeve may be near each other, including (directly) adjacent. The downhole tool may include a lower sleeve, which may be closer to the distal end.

In aspects, the expansion sleeve may be configured to expand from a first sleeve outer diameter to a second sleeve outer diameter that is larger than the first sleeve outer diameter. The expansion may occur without any type of (detrimental) fracture. On the other hand, the bearing ring may be configured with a failure point. The use or presence of the failure point may facilitate fracture of the bearing ring (such as at a fracture point, although other locations may be possible).

Any component of the downhole tool may be made of a dissolvable or other type of reactive material.

In operation or assembly of the downhole tool (e.g., in the wellbore), when the downhole tool is in a run-in configuration the cone need not engaged with the lower sleeve.

After setting the downhole tool to a first set configuration, the cone may be engaged with the lower sleeve. The expansion sleeve may have the first sleeve outer diameter in the run-in configuration.

In the run-in configuration the expansion sleeve may be engaged with the lower sleeve. After setting the downhole tool to a final set configuration, the expansion sleeve need not be engaged with the lower sleeve.

In embodiments, in the final set configuration the bearing ring may be fractured, but the expansion sleeve need not be.

The outer surface may have a first planar portion having a first outer (cone) diameter. The outer surface may have a second planar portion having a second outer (cone) diameter. In the run-in configuration the expansion sleeve may be (directly) engaged with the first planar portion. In the first set configuration the expansion sleeve may be directly engaged with the second planar portion.

In aspects, the outer surface may have a third planar portion having a third outer (cone) diameter. The second outer diameter may be larger than the first outer cone diameter. The third outer diameter is larger than the second outer diameter.

In other aspects, in the run-in configuration the expansion sleeve may be directly engaged with the first planar portion, and in the first set configuration the expansion sleeve may not be directly engaged with the first planar portion.

Yet other embodiments of the disclosure may pertain to a downhole setting system for use in a wellbore. The system may include a workstring. The system may include a setting tool assembly, which may be coupled with the workstring. The setting tool assembly may include a setting tool mandrel (or tension mandrel), which may have one or more ends. For example, there may be a first tension mandrel end and/or a second tension mandrel end. There may be a setting sleeve.

The system may include use of a tubular or tubular sub. The tubular may have a profile, the profile having a profile inner diameter. A side inner diameter of the tubular may be larger than the profile inner diameter.

The setting tool may be used to move a downhole tool from the run-in configuration to a first set configuration. It may be the case that the setting tool need not be used to move the downhole tool from the first set configuration to a second set configuration, as the setting tool may already be disconnected from the downhole tool.

Other embodiments herein pertain to a downhole tool for use in a wellbore that may include one or more of the following: a cone (also mandrel, cone mandrel, etc.); an expansion or first sleeve; a (bearing) ring disposed around the cone; and a lower sleeve or guide (shoe).

The cone may include a distal end; a proximate end; and an outer surface.

At least one component of the downhole tool may be made of a dissolvable material. Activation of the downhole tool in the wellbore may result in expansion of the sleeve and/or ring, but the tool need not be anchored wherein after activation. The downhole tool may have a first set position or configuration. The first set position may be an intermediate or armed position, which may facilitate ability of the tool to move from the first set position to a second set position. The second set position of the downhole tool may include the bearing ring engaged with one or both of the profile and a sidewall.

The downhole tool may have an inner flowbore. The inner flowbore may be associated with the cone. The flowbore may have an inner diameter in a bore range of any suitable size. In aspects, the range may be of at least 1 inch to no more than 5 inches.

Yet other embodiments of the disclosure pertain to a downhole setting system for use in a wellbore that may include one or more of: a workstring; a setting tool assembly coupled to the workstring; and a downhole tool.

The setting tool assembly may include a tension mandrel. The tension mandrel may have a first tension mandrel end and a second tension mandrel end. The assembly may include a setting sleeve.

The downhole tool may include a cone or mandrel. The cone may have a distal end; a proximate end; and an outer surface. There may be a lower sleeve coupled with the tension mandrel.

The tension mandrel may be disposed through the downhole tool. There may be a nose nut, clip, or other feature as part of or engaged with the tension mandrel end and/or the lower sleeve. There may be at least one component of the downhole tool made of a dissolvable material.

After activation via the setting tool assembly, the remnant downhole tool may be configured to move or be moved to engage or seat a surface (such as a shoulder). The downhole tool may be moved to a final or set configuration via fluid pressure and/or via use of a surrounding tubular (or tubular sub).

The cone may have a ball seat formed within an inner flowbore.

Other embodiments of the disclosure pertain to a downhole tool for use in a wellbore, which may include a cone or other comparable mandrel component having a distal end; a proximate end; and an outer surface. There may be one or more sleeves, such as an expansion sleeve engaged (slidingly, movingly, etc.) with the outer surface. There may be a lower sleeve proximate with the expansion sleeve.

The downhole tool may have a run-in configuration whereby the cone is not engaged with the lower sleeve, but after setting the downhole tool to a first set configuration, the cone may be engaged with the lower sleeve. Setting of the downhole tool to the first set configuration may result in expansion of the expansion sleeve, but the downhole tool remains free to move or be moved to engage a profile. The first set configuration may include the expansion sleeve sealingly engaged with the surrounding tubular (or tubular sub).

The tool may include a bearing ring. The bearing ring may be configured with a pre-determined failure point. In aspects, the cone may have a ball seat formed within an inner flowbore. In other aspects, in a second or final set position, the pre-determined failure point may be broken. The lower sleeve may have an inner recess configured to provide an interference or tolerance fit with a cone tip end, such as when the downhole tool is in the first set configuration.

Another embodiment of the disclosure pertains to a downhole setting system for use in a wellbore, which may include a workstring; and a setting tool assembly coupled to the workstring. The setting tool assembly may have a tension mandrel comprising a first tension mandrel end and a second tension mandrel end; and/or a setting sleeve.

The system may have a downhole tool having any of a cone, an expansion sleeve, a lower sleeve, and/or a bearing ring. The lower sleeve may be proximate the expansion sleeve, and coupled with the tension mandrel in a run-in configuration, The tension mandrel may be disposed through the downhole tool in the run-in configuration. In aspects, one or more components of the downhole tool may be made of a dissolvable material.

The system may include a tubular, whereby the tubular may have a tubular section or sub having a profile. In aspects, the profile may have a profile inner diameter, and a side inner diameter of the tubular may be larger than the profile inner diameter. The sub profile may have varied inner diameters that may facilitate setting of the downhole tool to a final set configuration.

In operation, after initial activation via the setting tool assembly, the downhole tool may be configured to move or be moved to seat on the profile, and thereby form a plug in support of a downhole operation once a ball is seated in the downhole tool. This may be the case even though the downhole tool may be sealingly engaged with the surrounding tubular.

Still other embodiments of the disclosure pertain to a method of using a downhole tool in a wellbore, the method may include any of the steps of: running the downhole tool in a run-in configuration to a position within a tubular disposed within the wellbore; activating or causing a setting tool assembly to move the downhole tool from the run-in configuration to a first or (intermediate) set configuration; and causing or operating the setting assembly whereby the downhole tool and the setting tool assembly disconnect from each other.

Thereafter, fluid or boost pressure and/or use of the tubular may be used to move the downhole tool from the first set configuration to a second or final set configuration.

The downhole tool may include a cone; an expansion sleeve engaged with the cone; and a lower sleeve engaged with the cone. In the first set configuration, the downhole tool need not be anchored against the tubular. As such, in the first set configuration, the downhole tool may be sealingly, but movingly engaged with the tubular. In aspects, at least one component of the downhole tool may be made of a dissolvable material. In other aspects, each of the cone and the lower sleeve are made of dissolvable material.

Any embodiment herein may include a downhole tool having at least one component with a one-piece, non-segmented configuration.

Any embodiment herein may include a downhole tool void of any segmented component.

Any embodiment herein may include a downhole tool void of a typical slip used for anchoring.

Any embodiment herein may include a downhole tool used with an accompanying method or system.

Any embodiment herein may include a downhole tool moved to a final set position without the use of a setting tool. As such, the downhole tool may be moved to a final set position even though the tool may be already disconnected from a workstring.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
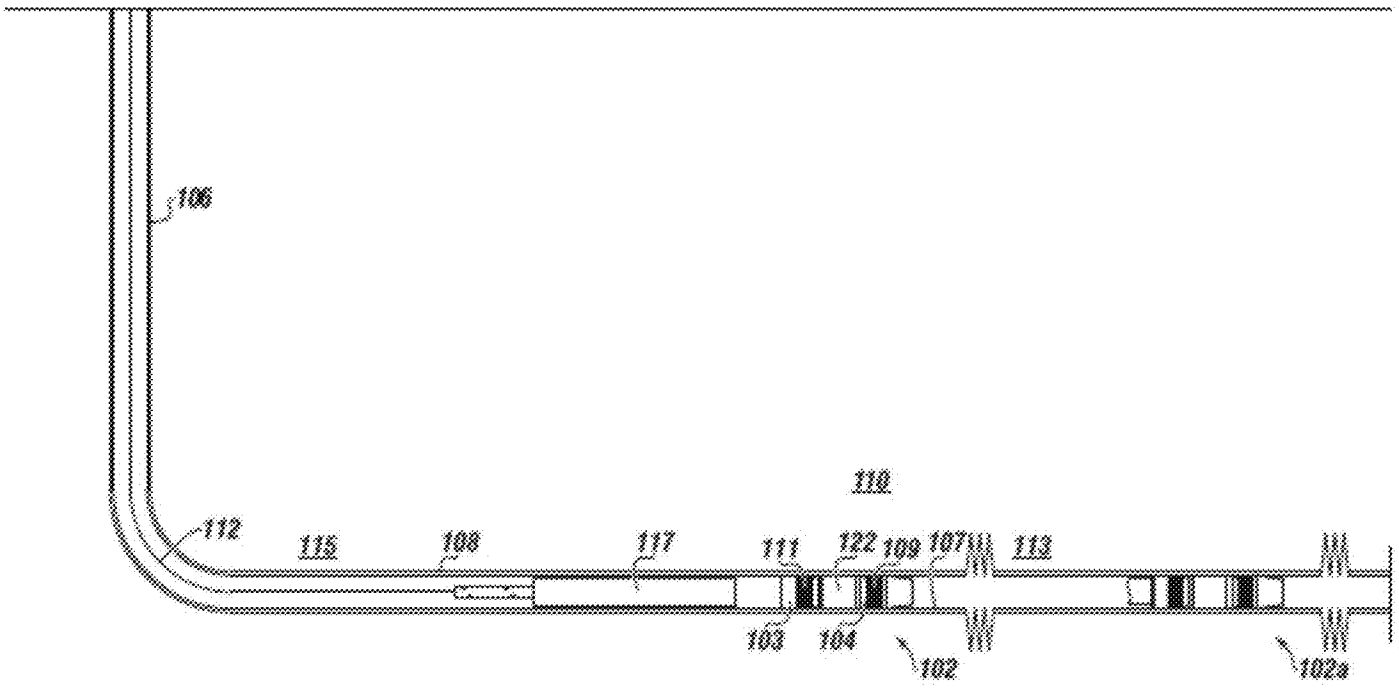
FIGURE 1 (PRIOR ART)
FIG. 1 is a side view of a process diagram of a conventional plugging system.

Herein disclosed are novel apparatuses, systems, and methods that pertain to and are usable for wellbore operations, details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional scaling materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication. Embodiments depicted in drawings need not be to scale.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "configuration" as used herein may refer to a position, arrangement, orientation, etc., with one or more words used interchangeably with no appreciable difference in meaning. Any configuration may be associated with a temporal moment in time. For example, at a first moment in time a downhole tool may have a first configuration, and at a second moment in time the downhole tool may have a second configuration. There may be an instance where a configuration is equivalent to another configuration, with any difference(s) discernable to one of ordinary skill in the art.

The term "workstring" as used herein may refer to a tubular (or other shape) that is operable to provide some kind of action, such as drilling, running a tool, or any other kind of downhole action, and combinations thereof.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", "string", or the like as used herein may refer to any fluid transmission means, and may be tubular in nature.

The term "composition" or "composition of matter" as used herein may refer to one or more ingredients, components, constituents, etc. that make up a material (or material of construction). Composition may refer to a flow stream, or the material of construction of a component of a downhole tool, of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac operation" as used herein may refer to fractionation of a downhole well that has already been drilled. 'Frac operation' can also be referred to and interchangeable with the terms fractionation, hydrofracturing, hydrofracking, fracking, fracing, frac, and the like. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "reactive material" as used herein may refer a material with a composition of matter having properties and/or characteristics that result in the material responding to a discernable change over time and/or under certain conditions. The term reactive material may encompass degradable, dissolvable, disassociatable, dissociable, and so on.

The term "degradable material" as used herein may refer to a composition of matter having properties and/or characteristics that, while subject to change over time and/or under certain conditions, lead to a change in the integrity of the material. As one example, the material may initially be hard, rigid, and strong at ambient or surface conditions, but over time (such as within about 12-36 hours) and under certain conditions (such as wellbore conditions), the material softens.

The term "dissolvable material" may be analogous to degradable material. The term as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-36 hours) and under certain conditions (such as wellbore conditions), the material softens. As another example, the material may initially be hard, rigid, and strong at ambient or surface conditions, but over time (such as within about 12-36 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "breakable material" as used herein may refer to a composition of matter having properties and/or characteristics that, while subject to change over time and/or under certain conditions, lead to brittleness. As one example, the material may be hard, rigid, and strong at ambient or surface conditions, but over time and under certain conditions, becomes brittle. The breakable material may experience breakage into multiple pieces, but not necessarily dissolution.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "machined" can refer to a computer numerical control (CNC) process whereby a robot or machinist runs computer-operated equipment to create machine parts, tools and the like.

Figure 2:
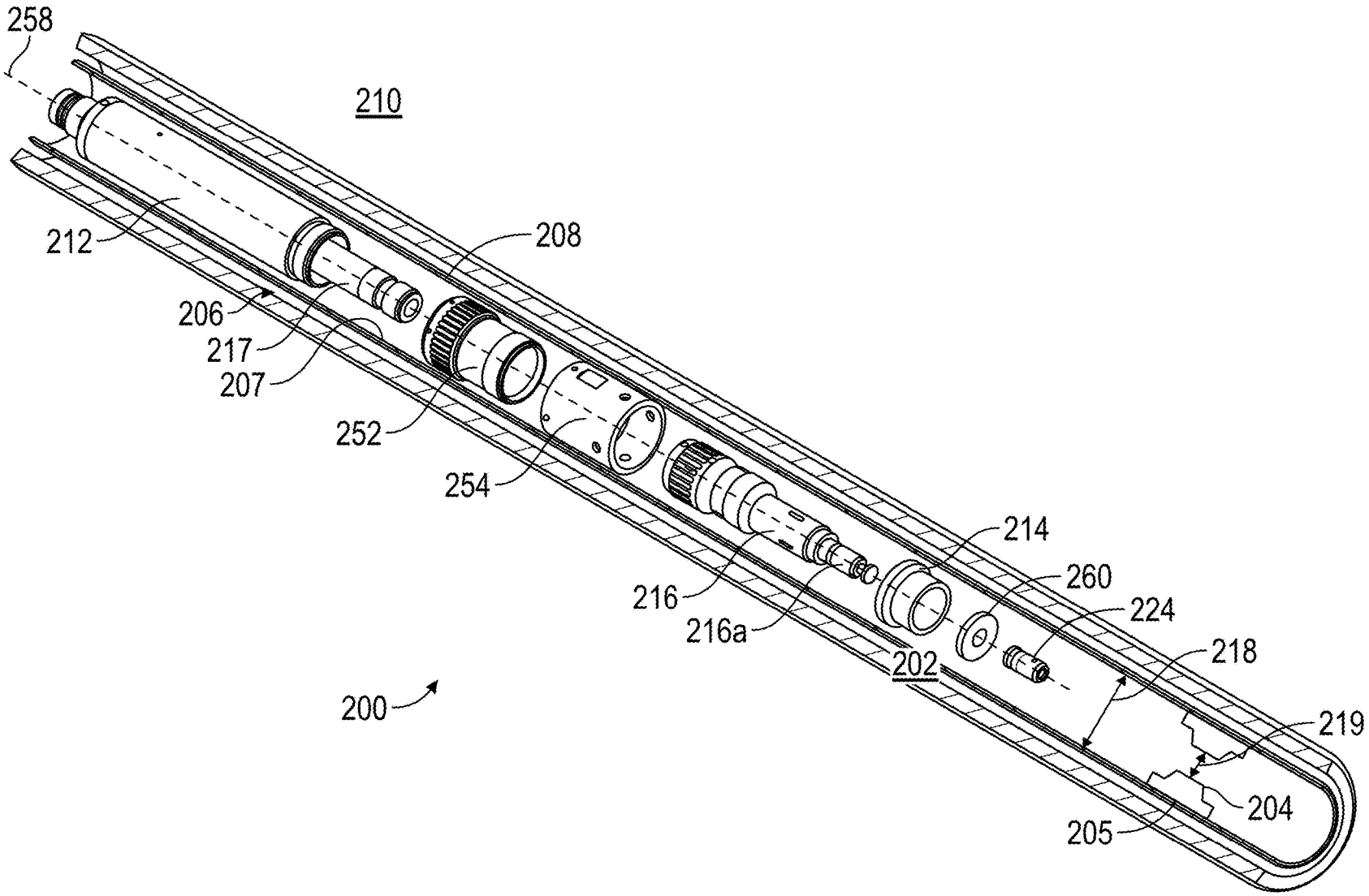
FIG. 2 shows an isometric view of a system having a downhole tool according to embodiments of the disclosure.

Referring now to FIG. 2, an isometric view of a system 200 having a downhole tool 202 illustrative of embodiments disclosed herein, are shown. FIG. 2 depicts a wellbore 206 formed in a subterranean formation 210 with a tubular 208 disposed therein. In an embodiment, the tubular 208 may be casing (e.g., casing, hung casing, casing string, etc.) (which may be cemented), and the like. The tubular 208 may be configured with a restriction or profile sub 205.

A workstring 212 (which may include a setting tool [or a part 217 of a setting tool] configured with an adapter 252) may be used to position or run the downhole tool 202 into and through the wellbore 206 to a desired location. One of skill would appreciate the setting tool may be like that provided by Baker or Owen. The setting tool assembly 217 may include or be associated with a setting sleeve 254. The setting sleeve 254 may be engaged with the downhole tool (or a component thereof) 202.

The setting tool may include a tension mandrel 216 associated (e.g., coupled) with an adapter 252. In an embodiment, the adapter 252 may be coupled with the setting tool (or part thereof) 217, and the tension mandrel 216 may be coupled with tool 217. The coupling may be a threaded connection (such as via threads on 217 and corresponding threads of the tension mandrel 216—not shown here). The tension mandrel 216 may extend, at least partially, out of the (bottom/downhole/distal end) tool 202.

An end or extension 216*a* of the tension mandrel 216 may be coupled with a nose sleeve or nut (or clip) 224. The nut 224 may have a threaded connection with the end 216*a* (and thus corresponding mating threads), although other forms of coupling may be possible. For additional securing, one or more set screws (not viewable here) may be disposed through set screw holes and screwed into or tightened against the end 216*a*. The nut 224 may engage or abut against a shear tab of a lower sleeve 260.

The downhole tool 202, as well as its components, may be annular in nature, and thus centrally disposed or arranged with respect to a longitudinal axis 258. In accordance with embodiments of the disclosure, the tool 202 may be configured as a plugging tool, which may be set within the tubular 208, albeit not in the traditional sense of a plugging tool.

That is, instead of the tool 202 being set in a manner whereby the tool 202 expands to engage the casing, the tool 202 may be activated initially by the setting tool assembly 217, but not to the point of fixed engagement with the surrounding tubular surface 207. As shown here, the restriction sub 205 may be configured with an extension or profile 204 that is tantamount to a narrowing of the tubular 208. For example, the tubular 208 may have a tubular inner diameter 218, whereas the profile has a profile inner diameter 219. The profile inner diameter 219 may be smaller than the tubular inner diameter 218, and thus provide the narrowance or smaller passageway. The profile inner diameter 219 is not shown to scale here. In some embodiments, the workstring 212 may be moved through the profile 204, whereby the tool 202 is activated once passed. The tool 202 may then be free to move toward a further or another restriction sub thereafter (not shown here).

In an embodiment, the downhole tool 202 may be configured to provide a plug, whereby flow from one section of the wellbore to another (e.g., above and below the tool 202) is controlled. In other embodiments, once a ball or other obstruction is seated in the tool 202, flow into one section of the wellbore 206 may be blocked and otherwise diverted into the surrounding formation or reservoir 210.

Once the tool 202 reaches the first activated position or configuration within the tubular 208, the setting mechanism or workstring 212 may be detached from the tool 202 by various methods, resulting in the tool 202 left movable in the surrounding tubular 208.

In an embodiment, once the tool 202 is in the desired position, tension may be applied to the setting tool (217) until a shearable connection or feature between the tool 202 and the workstring 212 is broken. However, the downhole tool 202 may have other forms of disconnect. The amount of load applied to the setting tool and the shearable connection may be in the range of about, for example, 20,000 to 55,000 pounds force.

In embodiments the tension mandrel 216 may separate or detach from a lower sleeve 260 (directly or indirectly)), resulting in the workstring 212 being able to separate from the tool 202, which may be at a predetermined moment. The loads provided herein are non-limiting and are merely exemplary. The setting force may be determined by specifically designing the interacting surfaces of the tool 202 and the respective tool surface angles.

One the tool 202 is disconnected from the setting tool assembly 217, the tool 202 may be further moved to second or another configuration via fluid (boost) pressure and/or use of the tubular 208.

Operation of the downhole tool 202 may allow for fast run in of the tool 202 to isolate one or more sections of the wellbore 206, as well as quick and simple drill-through or dissolution to destroy or remove the tool 202.

Accordingly, in some embodiments, drill-through may be completely unnecessary. As such the downhole tool 202 may have one or more components made of a reactive material, such as a metal or metal alloys. The downhole tool 202 may have one or more components made of a reactive material (e.g., dissolvable, degradable, etc.), which may be plastic, composite- or metal-based.

It follows then that one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react at first contact with the dissolving fluid, and remain viable about 3 to about 48 hours after setting of the downhole tool 202.

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components of the tool 202 may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components of tool 202 may be made of non-dissolvable materials (e.g., materials suitable for and are known to withstand downhole environments [including extreme pressure, temperature, fluid properties, etc.] for an extended period of time (predetermined or otherwise) as may be desired).

The downhole tool 202 (and other tool embodiments disclosed herein) and/or one or more of its components may be 3D-printed or made with other forms of additive manufacturing.

The downhole tool 202 may have a first (set) configuration while coupled with the workstring 212. The downhole tool 202 may remain in the first configuration upon disconnect from the workstring 212. The first configuration may be an intermediate or armed configuration. Thus, even though the downhole tool 202 may be contemplated as being in a set configuration, the downhole tool 202 may be moved to a second (set) or final configuration. The second configuration may be facilitated via the tubular 208 (or sub 205). In the first configuration the downhole tool 202 may be sealingly, but movingly engaged with the tubular 208.

Figure 3A:
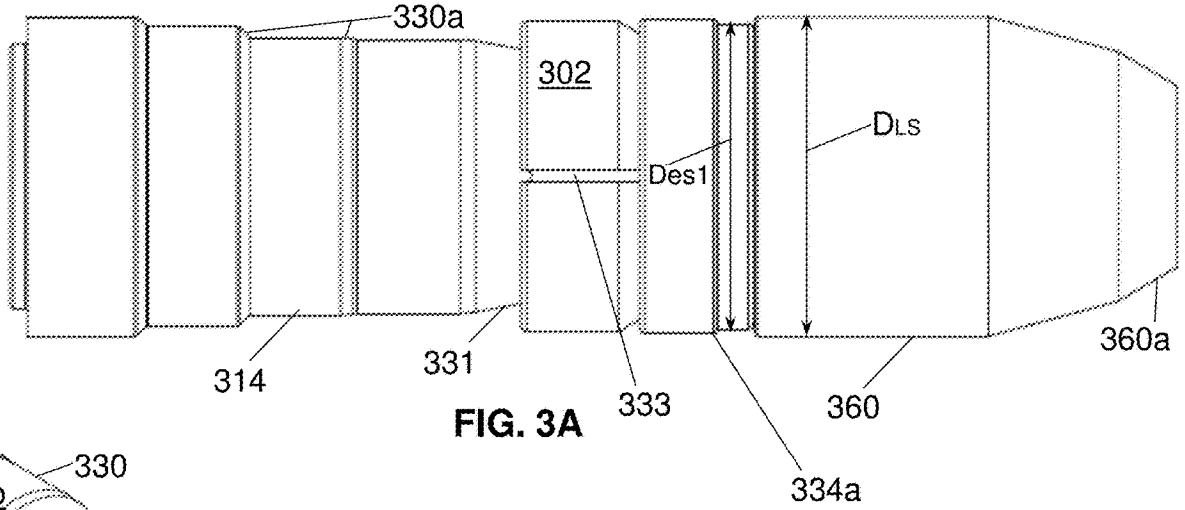
FIG. 3A shows a longitudinal side view of a downhole tool according to embodiments of the disclosure.
Figure 3B:
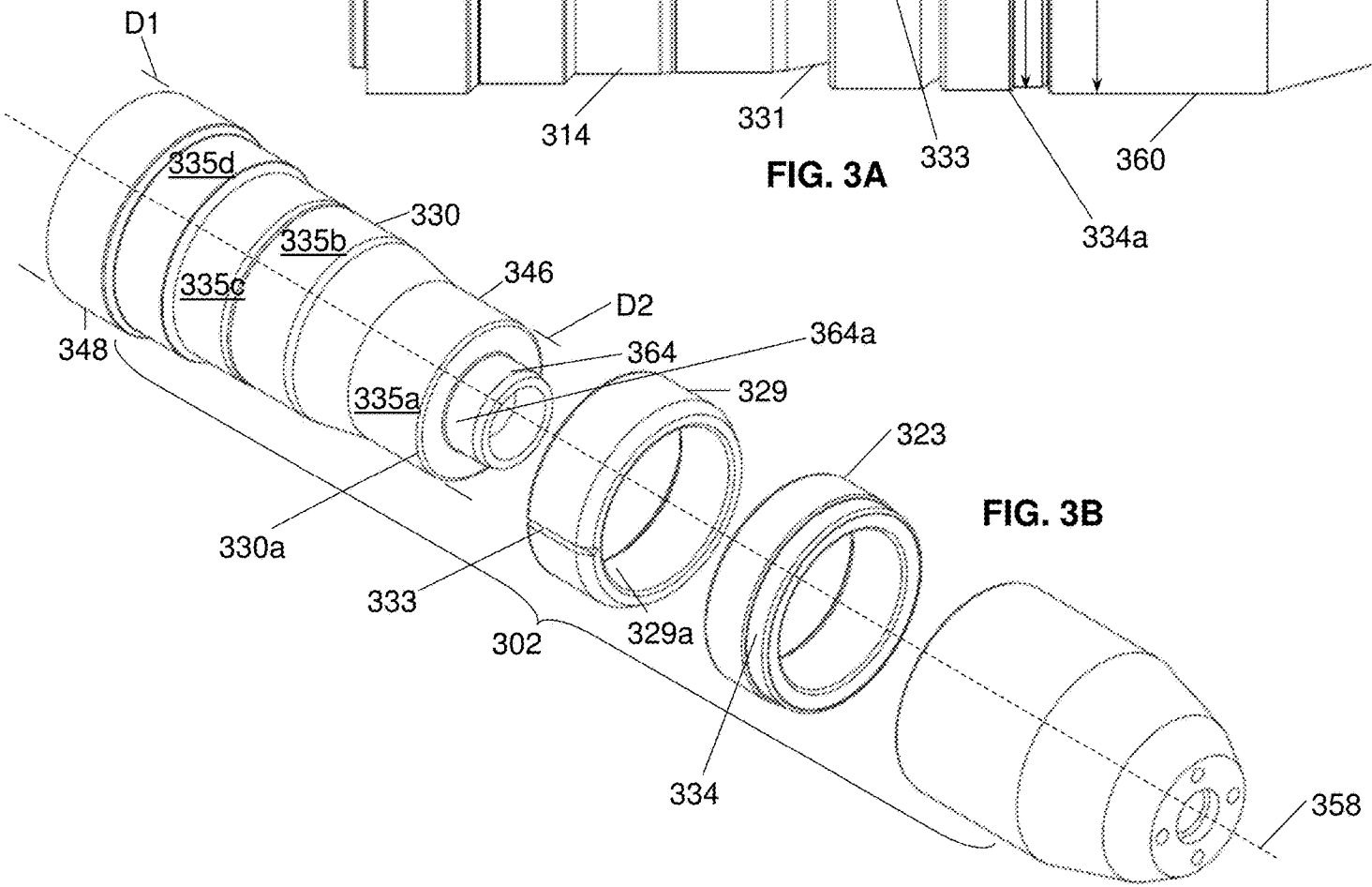
FIG. 3B shows an isometric component breakout view of the downhole tool of FIG. 3A according to embodiments of the disclosure.

Referring now to FIGS. 3A and 3B together, a longitudinal side view and an isometric component breakout view, respectively, according to embodiments of the disclosure, are shown. One of skill would appreciate the views of FIGS. 3A and 3B may be partial in nature.

FIGS. 3A and 3B together show a downhole tool 302 of embodiments herein may include a cone 314 and a lower sleeve or guide 360. The use of the term 'cone' may be used as a short hand reference to the shape of the component having a first dimension or (outer) diameter D1 at a proximate end 348 different in size from a second dimension or (outer) diameter D2 at a distal end 346.

However, an outer surface 330 of the cone 314 need not be continuous like one would expect for a typical geometrical cone shape. Instead, the outer surface 330 may be discontinuous with one or more different or varied dimensions. The outer surface(s) 330 may be planar in nature, and in cross-section lie parallel to a central (long) tool axis 358.

The outer surface 330 may have one or more segments or portions 335*a*, 335*b*, 335*c*, 335*d*, etc. Although not limited, FIGS. 3A-3B show the portion 335*a, b, c, d* may be or have a planar nature (e.g., in cross-section a plane or axis of the portion(s) may lie in parallel to a reference axis, such as axis 358). Each of the portions may have a respective surface portion outer diameter. Between the portions, the outer surface 330 may thus have one or more undulations or shoulders 330*a*. Any of the undulations may have a surface off axis from axis 358. For example, there may be a sloped surface 331. The sloped surface 331 may be suitable to engage an inner or underside surface of a surrounding component, such as a bearing ring inner surface 329*a*.

Although not limited, as seen here, the first diameter D1 may be larger than the second diameter D2. As the cone 314 may have one or more tool components disposed therearound, the term cone mandrel, mandrel, etc. may be used interchangeably.

These components, while part of the downhole tool 302, need not be engaged at all times. For example, in a run-in configuration the cone 314 may not be engaged with the lower sleeve 360. The cone 314 and lower sleeve 360 may be configured for operation with a setting tool assembly (e.g., 417, FIG. 4A). When the cone 314 is arranged around a tension mandrel (416), the cone outer surface 330 may have one or more components disposed therearound. For example, there may be a plurality of rings or sleeves disposed (at least partially) around the cone 314 (or its outer surface 330). As shown here, there may be a bearing or load ring 329 in proximity to an expansion (expandable, etc.) sleeve 323. As will be discussed, the sleeve 323 may have a recess or other suitable surface 334, which provides a sleeve shoulder or edge 334*a*.

The cone outer surface 330 may terminate at a shoulder end 330*a*; however, the cone 314 may have a cone tip 364 extend therefrom. The cone tip 364 may have a cone tip outer surface 364*a*. In an analogous manner, the lower sleeve 360 may have an inner sleeve body configured with one or more annular ridges or recesses (not viewable here). The inner sleeve recess surface may be configured to engage the cone tip outer surface 364*a*. The lower sleeve 360 may have another sleeve surface configured to engage the cone 314. For example, the another sleeve surface may engage the cone outer surface 330.

In operation, and upon activation to move from a run-in configuration to another or first configuration, compression force generated by the setting tool may urge the bearing ring 329 and/or the expansion ring 323 up/against the ramped or angled surface 331 of the cone 314 via the lower sleeve 360 until the sleeve 360 locates on or proximate shoulder end 330*a*. Or until the cone tip 364 extends all the way into the recess of the sleeve 360. After shearing and setting, the cone tip 364 may remain engaged against the recess via interference or tolerance fit.

Figure 4A:
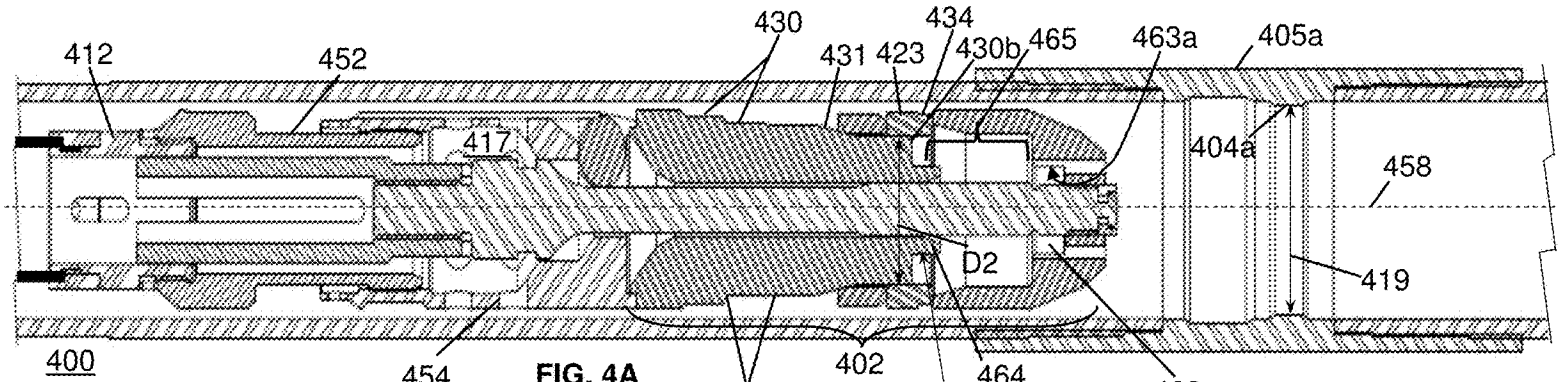
FIG. 4A shows a longitudinal side cross-sectional view of a system having an unset downhole tool in a run-in configuration according to embodiments of the disclosure.
Figure 4B:
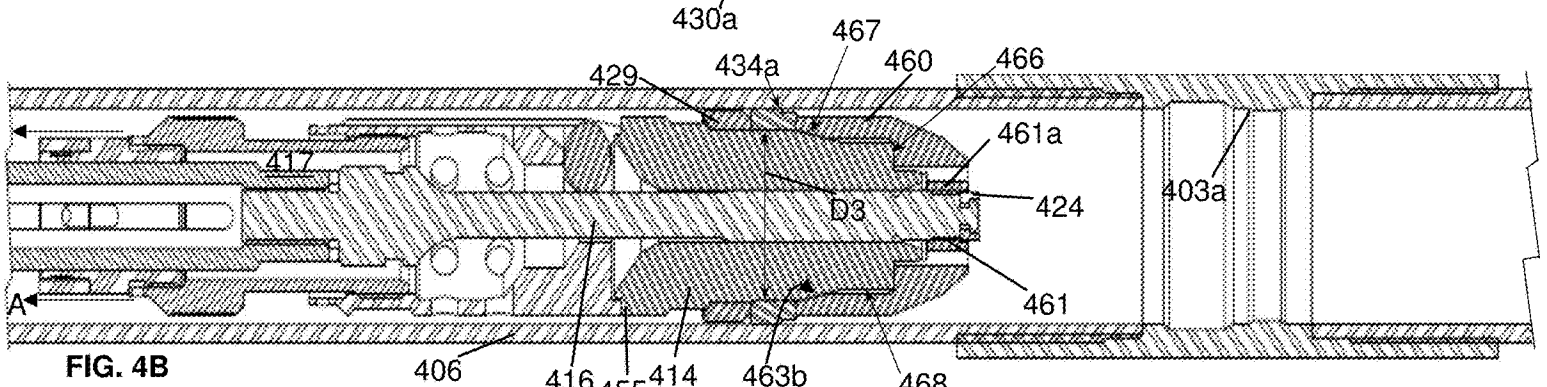
FIG. 4B shows a longitudinal side cross-sectional view of the downhole tool of FIG. 4A in a first set configuration according to embodiments of the disclosure.
Figure 4C:
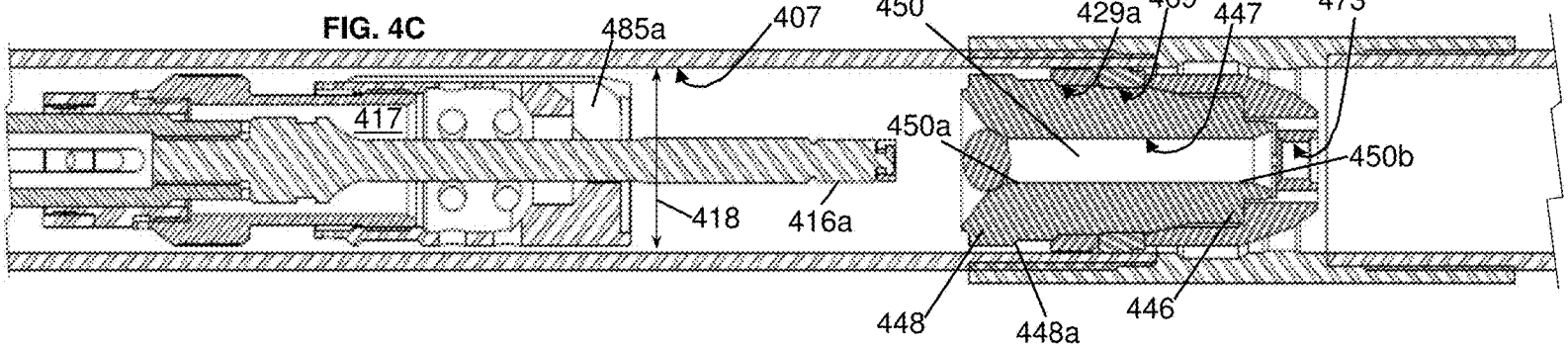
FIG. 4C shows a longitudinal side cross-sectional view of the downhole tool of FIG. 4B disconnected from a workstring according to embodiments of the disclosure.
Figure 4D:
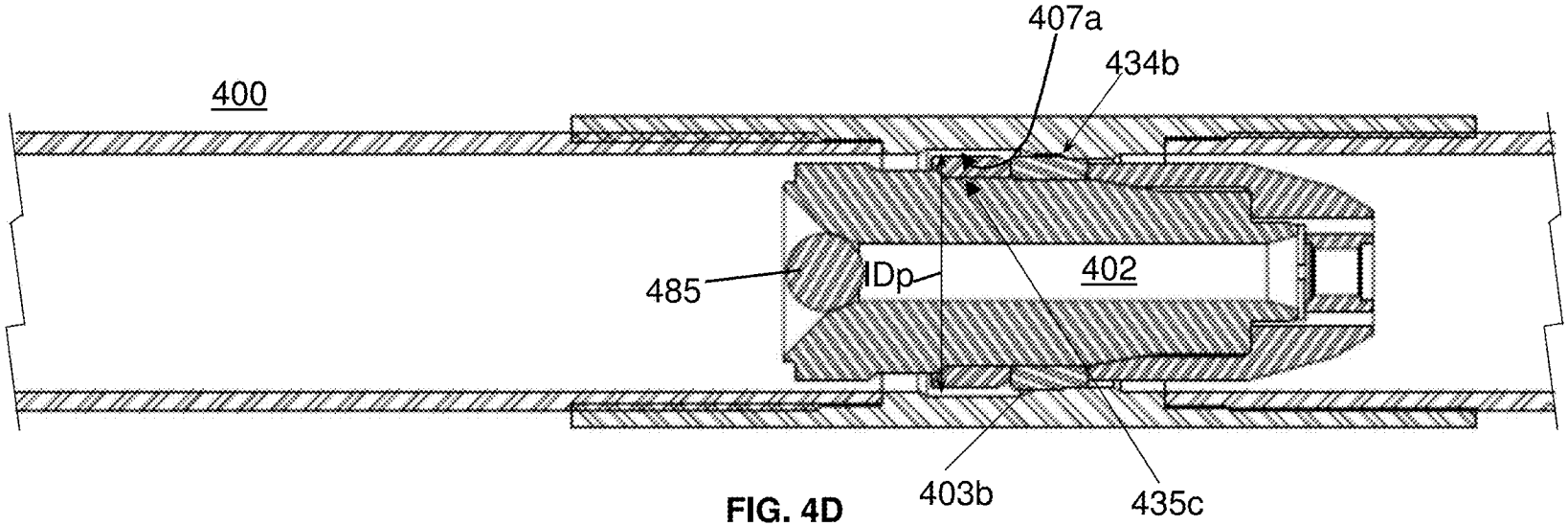
FIG. 4D shows a longitudinal side cross-sectional view of the downhole tool of FIG. 4C urged against a profile (or profile sub) according to embodiments of the disclosure.

Referring now to FIGS. 4A, 4B, 4C, 4D, and 4E together, a longitudinal side cross-sectional view of a system having an unset downhole tool in a run-in configuration, a longitudinal side cross-sectional view of the downhole tool of FIG. 4A in a first set configuration, a longitudinal side cross-sectional view of the downhole tool of FIG. 4B disconnected from a workstring, a longitudinal side cross-sectional view of the downhole tool of FIG. 4C urged against a profile sub, and a longitudinal side cross-sectional view of the downhole tool of FIG. 4D in a second set configuration, respectively, according to embodiments of the disclosure, are shown. One of skill would appreciate the views of FIGS. 4A-4E may be partial in nature. The setting device(s) and components of the downhole tool 402 may be coupled with, and axially and/or longitudinally movable, at least partially, with respect to each other.

Embodiments herein provide for a downhole tool that may have as few as three basic parts, plus a dissolvable ball. An expandable sleeve may be machined to an OD which easily passes through a restriction(s) or other type of profile in the wellbore, of which the restriction/profile may be configured to provide a seat-type surface for the tool. When at setting depth (which may be predetermined), the expandable sleeve may be expanded in diameter larger than the restriction diameters in the surrounding tubular (e.g., casing string).

In a run-in configuration, the expandable sleeve may have a first sleeve (outer) diameter, and in a final, set configuration the expandable sleeve may have a second sleeve (outer) diameter. The second sleeve diameter may be larger than the first sleeve diameter. In the final, set configuration, the expandable sleeve may have an expanded configuration, yet also maintains or has integrity through one-piece connectivity around its periphery.

Expansion of the sleeve may occur by urging a cone (mandrel) into engagement with a lower sleeve, such as via the use of a wireline setting tool, until the two parts locate on corresponding shoulders in both parts. Once expanded, the sleeve and cone may be locked or otherwise held together via friction, press- or interference-fit, or comparable. These parts may be secured to the setting tool with the lower sleeve, which may be configured with a shear feature (threads, pins, tabs, etc.). Once adequate force is generated to shear the lower sleeve, the downhole tool (and its components) may be released from the setting tool. The setting tool may then be retrieved from the well after firing perforating guns run above the setting tool. The downhole tool, in the expanded condition tantamount to a set configuration, need not (sealingly or securingly) engage the tubular ID, and instead may be free floating therein. Additional fluid or boost pressure (and/or the surrounding tubular) may be used to further expand the sleeve. In this respect, the downhole tool may be sealingly, yet movingly engaged with the surrounding tubular, such that fluid pressure may not bypass therearound.

Other embodiments herein pertain to a downhole tool that may include the expandable sleeve or ring (such as a seal ring), which may be urged or otherwise driven up or against a cone member (or outer conical surface) during setting. This may provide the interference with the restriction/profile. Releasing from the setting tool may be comparable to other embodiments described herein. The length of the expandable sleeve or ring may dictate how much differential pressure the tool can withstand. The outer cone surface (or 'ramp angle') may dictate the setting force required to fully expand the sleeve.

Once wireline is out of the hole, a dissolvable ball or other type of obstruction may be pumped to its seat in the tool (any embodiment), and may push the tool downhole until downhole tool lands on the next lower profile sub in the well. In other aspects, the ball may be run-in as part of the tool assembly coupled with the workstring. The tool may seat on the profile forming a pressure barrier for the subsequent frac job. Profile subs may be installed in the tubular string when the tubular is run.

Advantageously, a downhole tool embodiment of the present disclosure need not anchor to the surrounding tubular, such as with traditional plugs-thus there is no damage to the tubular from hardened slip teeth or buttons. At the same time, the downhole tool may utilize the tubular (or profile thereof) to facilitate moving to a final set configuration. The tool location during the fracturing operation may be defined by the location of the profile subs run in the tubular string.

Embodiments herein may pertain to a downhole system 400 that includes a wellbore 408 (shown only in part in FIG. 4E) having a tubular (such as a casing string or the like) 406 disposed therein. The tubular 406 may be made up of a plurality of joints, subs, collars, etc., any of which may be coupled together or integral. A workstring 412 (shown only in part here) may be used to run a downhole tool 402 into the tubular 406 to a desired position.

The downhole tool 402 may include a cone (cone member, mandrel, etc.) 414 that extends at least partially through or as the 402 (or tool body). The cone 414 may have an outer surface 430 with one or more planar surfaces parallel to tool axis 458. The outer surface 430 may have one or more shoulders or undulations 430*a*. There may (also) be one or more 'conical' (frustoconical, etc.) surfaces 431 (e.g., a surface off-axis to long axis 458).

The cone 414 may include a flowpath or bore 450 formed therein (e.g., an axial bore). The bore 450 may extend partially or for a short distance through the cone 414. Alternatively, the bore 450 may extend through the entire cone 414, with an opening at its proximate end 448 and oppositely at its distal end 446 (near downhole or bottom end of the tool 402).

The presence of the bore 450 or other flowpath through the cone 414 may indirectly be dictated by operating conditions. That is, in most instances the tool 402 may be large enough in diameter (e.g., 4¾ inches) that the bore 450 may be correspondingly large enough (e.g., 1¼ inches) so that debris and junk may pass or flow through the bore 450 without plugging concerns. Diameters greater than 4¾ inches and less than 1¼ inches may be used in certain instances, where desired.

With the presence of the bore 450, the cone 414 may have an inner bore surface 447, which may be smooth and annular in nature. In cross-section, the bore surface 447 may be planar, such as from a first bore end 450*a* to second bore end 450*b*. The ends 450*a*, 450*b* need not be the furthest end points of the bore 450. In embodiments, at least a portion of the bore surface 447 (in cross-section) between the ends 450*a*, 450*b* may be parallel to a reference axis, such as the (central) tool axis 458. As mentioned, the outer cone surface 430 may have one or more surfaces 431 (in cross-section) offset or angled to the tool axis 458.

The bore 450 (and thus the tool 402) may be configured for part of a setting tool assembly 417 (shown only in part here) to fit therein, such as a tension mandrel 416. Thus, the tension mandrel 416, which may be contemplated as being part of the setting tool assembly 417, may be configured for the downhole tool 402 (or components thereof) to be disposed therearound (such as during run-in or in an assembled or run-in configuration).

In assembly, the downhole tool 402 may be coupled with the setting tool assembly 417 (and around, at least in part, the tension mandrel 417), but need not be in a threaded manner. In an embodiment, the downhole tool 402 (by itself, and not including setting tool components) may be completely devoid of threaded connections. If used, an adapter 452 (or comparable sleeve component) may include threads thereon. Such threads (not shown here) may correspond to mate with threads of a setting sleeve 454.

As shown, a lower sleeve 460 may be configured with a shear feature 461, such as shear treads, shear rib, shear tab, shear pin, etc. The shear feature 461 may be engaged with the setting tool assembly 417. As shown, the shear feature 461 may be engaged or proximate to each or either of the tension mandrel 416 and a nose nut or other suitable securing member(s) (clip, etc.) 424. The lower sleeve 460 (or the shear point) may be configured with the feature 461 that facilitates or promote deforming, and ultimately shearing/breaking, during setting. As such, the shear feature 461 may have at least one recess region or fracture groove (not shown here; tantamount to a predetermined and purposeful failure point of the lower sleeve 460).

The shear feature 461 may be configured to shear at a predetermined point. The shear feature 461 may be disposed on or within an inner lower sleeve bore 473. The shear feature may correspond to or alternatively be configured as a respective feature 461*a* that may be disposed on a lower tension mandrel end 416*a*.

During setting, when the tool 402 may be moved from a run-in configuration to a first (set) configuration, as the tension mandrel 416 (and thus tension mandrel end 416*a*) continues to be pulled in direction A, force may continue to exert on the shear features 461, 461*a*, ultimately resulting in shearing (breaking, etc.). The shear feature 461 may be configured to shear at a load greater than the load for setting the tool 402. Thus, the force to move the tool 402 to the first configuration (FIG. 3B) may be less than the force used to disconnect the tool 402 from the setting stool 417 (FIG. 3C).

Once sheared (disconnected), the tool 402 may be free to move within the tubular 406; however, in the now-expanded state corresponding to the first configuration, the downhole tool 402 may not fall any further than respective profile 404*a* of a lower profile sub 405*a*. The downhole tool 402 may be sealingly, movingly engaged with the tubular 406 in the first configuration.

The lower profile sub 405*a* may be joint, collar, etc. coupled with or as part of the tubular 406. The tubular 406 may be run in the wellbore 408 with one or more profile subs 405*a* disposed therewith. There may be a first profile sub (not shown here) above the lower profile sub 405*a*. There may be another profile sub (not shown here) below the lower profile sub 405. The profile 404*a* or profile sub 405*a* may be integral to or part of the tubular 406.

FIG. 4A shows the downhole tool 402 may be run into tubular 406 to a desired depth or position by way of the workstring 412 (shown in part) that may be configured with the setting tool assembly 417. The workstring 412 and setting tool 417 may be part of the tool system 400 utilized to run the downhole tool 402 into the wellbore and activate the tool 402 to move from a run-in or unset configuration to a first, set configuration.

The first set or activated configuration of the tool 402 may include components of the tool 402 compressed together, but the tool 402 need not be set or engaged against the tubular 406 (which may be defined by an inner tubular diameter 418 of an inner tubular surface 407). In aspects, although perhaps (slightly) confined, the tool 402 may be sealingly engaged, yet freely movable unless and until it may be urged into engagement with a shoulder 403*a* of profile 404*a* (see 4D). The profile 404*a* may have an inner profile diameter 419. Although illustrated here as the inner profile diameter 419 may be smaller than the inner tubular diameter 418, it may be the case in some embodiments that opposite may occur—that diameter 419 may be larger than diameter 418.

The setting device(s) and components of the downhole tool 402 may be coupled with, and axially and/or longitudinally movable along or in a working relationship with the cone 414. When the initial setting sequence begins, the lower sleeve 460 may be pulled via tension mandrel 416 while the setting sleeve 454 remains stationary.

As the tension mandrel 416 is pulled in the direction of Arrow A, one or more the components may begin to compress against one another as a result of the setting sleeve 454 (or end its end) held in place against an end surface 455 of the proximate end 448 of the cone 414. This force and resultant movement may urge an expansion sleeve or ring 423 to compressively slide against the angled cone surface 431 of the cone 414, and ultimately expand. Thus, the expansion ring 423 may be movingly (such as slidingly) engaged with the cone mandrel 414.

As the lower sleeve 460 is pulled further in the direction of Arrow A, the lower sleeve 460 (being engaged with the expansion sleeve 423) may urge the 423 to compressively slide against the cone surface 431. As expansion occurs, the sleeve 423 may move radially outward, which may include expanding into (sealing) engagement with the surrounding tubular 406; but at least not to the degree that the tool 402 may not move. FIGS. 4A and 4B depict the run-in configuration with the sleeve 423 in its initial state (at least partially) disposed around lower outer diameter D2 as compared to the first set configuration with the sleeve expanded and (at least partially) disposed around next outer diameter D3. As seen, the next outer diameter D3 may be larger than the lower outer diameter D2.

Figure 4E:
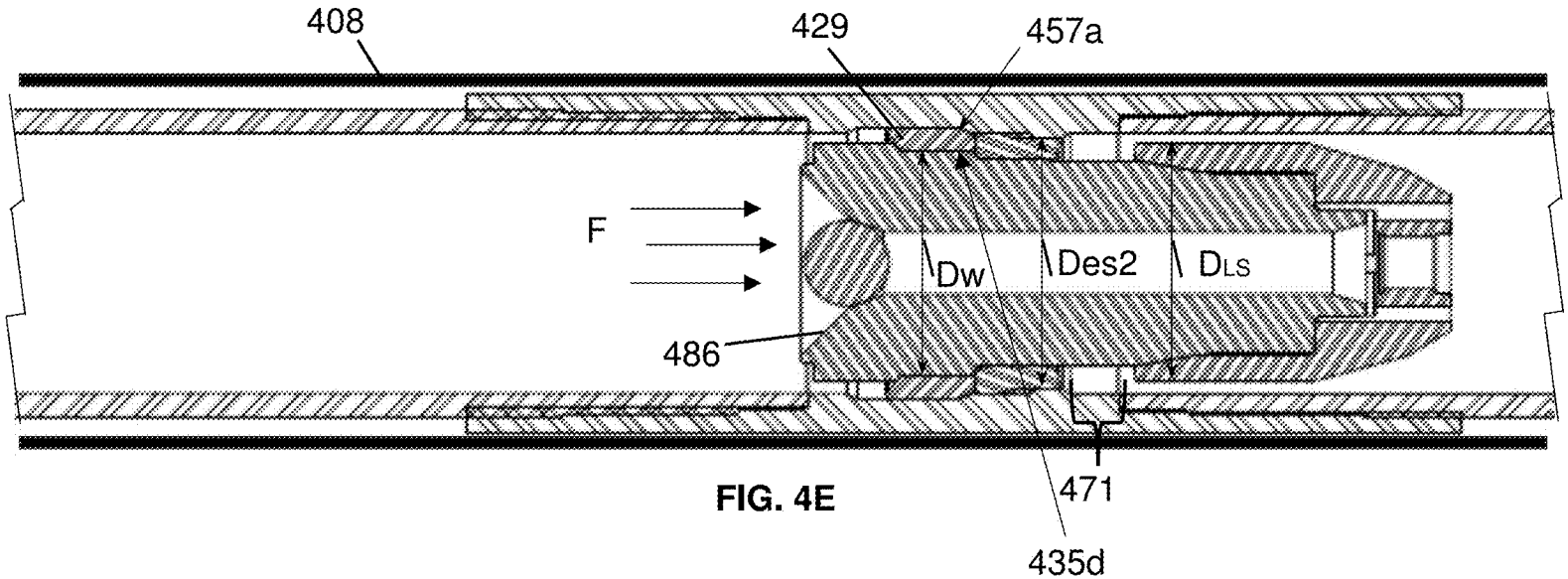
FIG. 4E shows a longitudinal side cross-sectional view of the downhole tool of FIG. 4D in a second set configuration according to embodiments of the disclosure.

The expansion sleeve 423 may be moved and urged against or into a bearing ring 429 (which may have a pre-determined failure point; see, e.g., 333, FIGS. 3A-3B). FIGS. 4A and 4B also show the sleeve 423 in the run-in configuration disposed around diameter D2 and moving against surface 431, and thereby moving to the first set configuration with the ring 429 expanded radial outward. FIG. 4E shows the ring 429 moved to its most prominent (widest) diameter Dw, and into (moving) engagement with the side surface 407*a* of sub 405*a*, and provided sufficient fluid pressure F, the ring 429 may engages shoulder or profile 403*b* (see contact point 457*a*; the ring 429 being sufficient in strength to withstand the compressive longitudinal load thereagainst).

As shown in FIG. 4E, the downhole tool 402 may have a second (set) configuration (or also final set configuration), which may include the ring 429 expanded at diameter Dw, the ring 429 engaged with shoulder 403*b*, the ring engaged with a proximate end shoulder 448*a*, the expansion sleeve 423 engaged with shoulder 403*a*, the lower sleeve 460 engaged with the cone 414, and/or the expansion sleeve 423 not engaged with the lower sleeve 460 (see gap 471).

In the final set configuration, the expandable sleeve 423 may have an outer sleeve diameter that is larger than an original outer sleeve diameter in the run-in configuration; however, the sleeve 423 may only be expanded, but still together [thus not fractured or broken], at least partially, around its periphery. Also, in the final set configuration the bearing ring 429 may be fractured or broken at the predetermined failure point (333); thus, the ring 429 may not be together around the entire periphery.

FIG. 4A shows the downhole tool 402 (or system 400) having a run-in configuration; FIG. 4B showing a first activated configuration that is not the run-in configuration (which may be a first, set configuration, armed configuration, intermediate configuration, etc.); FIG. 4C shows the first configuration may be associated with a disconnected configuration, whereby the tool 402 and the setting tool 417 may be disconnected; FIG. 4D shows the tool 402 in the first configuration moved into engagement with a profile 404*a*; and FIG. 4E shows the tool 402 in the second or final activated configuration (which may be a second, set or final configuration, or comparable).

The cone 414 may be configured with a ball seat 486 formed or removably disposed therein. In some embodiments, the ball seat 486 may be integrally formed within the bore 450 of the cone 414. As shown here, the ball seat 486 may be formed proximate first bore end 450*a*. In other embodiments, the ball seat 486 may be separately or optionally installed within the cone 414, as may be desired.

The ball seat 486 may be configured in a manner so that a ball 485 or other form of plug/obstruction may seat or rest therein, whereby the flowpath through the cone 414 may be closed off (e.g., flow through the bore 450 is restricted or controlled by the presence of the ball). In this respect, once the setting tool 417 and the workstring 412 are disconnected from the tool 402, the ball 485 may be free to seat thereagainst.

For example, fluid flow F from one direction may urge and hold the ball 485 against the seat 486, whereas fluid flow from the opposite direction may urge the ball 485 off or away from the seat 486. As such, the ball may 485 be used to prevent or otherwise control fluid flow through the tool 402. The ball 485 may be conventionally made of a composite material, dissolvable material, phenolic resin, etc., whereby the ball may be capable of holding maximum pressures experienced during downhole operations (e.g., fracing).

While not limited, a diameter of the ball 485 may be in in a ball diameter range of about 1 inch to about 5 inches. The bore 450 may have an inner bore diameter in a bore diameter range of about 1 inch to about 5 inches. As such, the cone 414 may have suitable wall thickness to handle load and prevent collapse.

The ball 485 may be any type of ball apparent to one of skill in the art and suitable for use with embodiments disclosed herein, including any such ball may be a ball held in place or otherwise positioned within a downhole tool. As shown in FIG. 4A, the ball 485 may be housed within a ball chamber 485*a* during run-in.

The ball 485 may be a "smart" ball (not shown here) configured to monitor or measure downhole conditions, and otherwise convey information back to the surface or an operator, such as the ball(s) provided by Aquanetus Technology, Inc. or OpenField Technology In other aspects, the ball may be made from a composite or dissolvable material. Other materials are possible, such as glass or carbon fibers, phenolic material, plastics, fiberglass composite (sheets), plastic, etc.

The ball 485 may be configured or otherwise designed to dissolve under certain conditions or various parameters, including those related to temperature, pressure, and composition.

Although not shown here, the downhole tool 402 may have a pumpdown ring or other suitable structure to facilitate or enhance run-in. The downhole tool 402 may have a 'composite member' like that described in U.S. Pat. No. 8,955,605, incorporated by reference herein in its entirety for all purposes, particularly as it pertains to the composite member.

FIG. 4A shows the downhole tool 402 in the run-in configuration may have a first clearance 465 formed between the lower sleeve 460 and the tension mandrel 416 and/or cone 414. This means that in the run-in configuration, the lower sleeve 460 and the cone 414 may not be engaged together. FIGS. 4B, 4C, etc. show the first clearance 465 removed or diminished as a result of a first contact point 466 between the cone 414 and the lower sleeve 460, which may result when the downhole tool 402 is moved to the first set configuration, or any configuration thereafter. In the first set configuration, or another configuration thereafter, there may be a second clearance 468 that is formed between first contact point 466 and a second contact point 467.

Although not shown here, either or both rings 429, 423 may have may have a respective inner ring surface 429*a*, 469 configured with one or more undulations or grooves. The presence of the grooves may facilitate improved (sliding/moving) engagement between the rings 429 and/or 423 and the cone 414. In embodiments, a friction reducer (such as grease) or the like may be disposed on the surfaces 429*a*, 469, including within the grooves, if present.

The cone outer surface 430 may terminate at a shoulder end 430*b*; however, the cone 414 may have a cone tip 464 extend therefrom. The cone tip 464 may have a cone tip outer surface 464*a*. In an analogous manner, the lower sleeve 460 may have an inner sleeve body configured with one or more annular ridges or recesses, such as recess or groove 463. In inner sleeve recess surface 463*a* may be configured to engage the cone tip outer surface 464*a* (see by way of example, first contact point 466, FIG. 4B).

The lower sleeve 460 may have another sleeve surface 463*b* configured to engage the cone 414. For example, the another sleeve surface 463*b* may engage the cone angled outer surface 431 (see by way of example, second contact point 467, FIG. 4B).

Upon activation, compression force generated by the setting tool may urge the expansion ring up/against the ramped or angled surface 430 of the cone 414 via the lower sleeve 460 until the sleeve locates on or proximate shoulder end 430*a*. Or until the cone tip 464 extends all the way into the recess 463. After shearing and setting, the cone tip 464 remains engaged against the recess 463 via interference or tolerance fit.

Another way to contemplate operation of the system 400 is that the setting tool 417 may be used to move or activate the downhole tool 402 from the run-in configuration to the first set configuration, but the setting tool 417 need not be used to move the downhole tool 402 from the first set configuration to the second set configuration.

Instead, the downhole tool 402 may have a surface or feature that may engage the profile 404*a*. For example, the expandable sleeve 423 may have a recessed surface 434 that allows sleeve shoulder 434*a* to engage the profile 404*a* (see contact point 434*b*). The expandable sleeve 423 may be configured for a pre-determined and desired failure point, such as by deformation or extrusion.

The ability for the expandable sleeve 423 to undergo physical change may facilitate the tool 402 moving from one configuration to another configuration. Although the sleeve 423 and ring 429 may be made of a comparable material (e.g., magnesium), it may be the case that the yield strength of the sleeve 423 is lower (such that the sleeve 423 may readily change shape, deform, etc.). On the other hand, it may be the case the ring 429 is made of a relatively higher yield strength, whereby the ring 429 may much more accommodate compressive loading of the tool (allowing the sleeve 423 to manage holding sealing engagement).

Fluid pressure F (or an increase thereof) against the plug 485 may result in urging the shoulder 434*a* against the surface 434. In this position the fluid F may be prevented or mitigated from bypassing any further around the tool 402, such that the tool 402 may be sealingly engaged with the tubular 406. In this way the fluid F may act against the tool 402.

At the same time, the bearing ring 429 may fracture, or may have already fractured, sufficiently to allow sleeve 423 to urge the ring 429 further against the outer surface 430. Fo4 example, the sleeve 423 may move from third segment or planar portion 435*c* onto the fourth segment or planar portion 435*d* (associated with widest surface outer diameter Dw).

At this point, the sleeve 423 may be at its greatest width, and as such may (sealingly) engage against profile or tubular inner surface 407*a* (corresponding to surface 407*a* inner profile diameter $D_{ip}$). In this way, it is the tubular 406 (or sub 405*a*), and/or fluid or boost pressure F, which may be used to move the downhole tool 402 to a second or final set configuration (FIG. 4E). As such, it may be the case that a setting tool need not be required to move the tool 402 to its final, set configuration.

As would be apparent, when at setting depth (which may be predetermined), the expandable sleeve 423 and the bearing ring 429 may be expanded in diameter larger than the profile diameters in the surrounding tubular (e.g., casing string). In the run-in configuration, the sleeve recess 434 may have a first outer recess diameter $D_{ES1}$. The first outer recess diameter $D_{ES1}$ may be smaller than a first outer lower sleeve diameter $D_{LS}$ in the run-in configuration.

After expansion of the sleeve 423 (such as to the first configuration and thereafter), the sleeve recess 434 may have a second outer recess diameter $D_{ES2}$, which may now be larger than the first outer lower sleeve diameter $D_{LS}$.

Embodiments herein may provide for an expansion sleeve (or comparable) that may be movable as part of the downhole tool, even after expansion (such as moving to a first set configuration). The expansion sleeve may, at least initially, have a smaller OD than what would be a drift ID (e.g., as defined per API 5CT) of a surrounding tubular. When moved to another configuration from that of the run-in configuration, the sleeve may now have an OD larger than one or more profile IDs of the surrounding tubular. The surrounding tubular may include a tubular sub having the one or more profile IDs.

The expansion sleeve may be expanded into sealing engagement with the surrounding tubular (which facilitates uphole or boost pressure ability to act against the downhole tool). In another configuration, which may be a (optional) final configuration, the expansion sleeve may be used to hold pressure, and a bearing ring may be used as a load-bearing component of the tool. The bearing ring may be configured to withstand upwards of 10,000 psi fluid pressure (or higher).

The expansion sleeve may be configured to extrude and deform (e.g., a pre-determined and desired failure point), such that the tool may further shift and allow the bearing ring to engage and hold against an inner surface contact point. In this respect, the expansion sleeve may have a lower yield strength relative to that of the bearing ring, even though both may be made of a comparable (dissolvable) material.

The run-in configuration may include the cone or mandrel not engaged with the lower sleeve.

The first set configuration may include the cone or mandrel engaged with the lower sleeve. This configuration may include the downhole tool disconnected from the setting tool assembly (or workstring). This configuration may include the expansion sleeve sealingly, but movingly engaged with the surrounding tubular (or respective inner surface thereof).

The second or final set configuration may include at least one component of the downhole tool engaged with a tubular surface having a larger ID than a drift ID or another ID of the surrounding tubular.

The first set configuration may include the use of the setting tool assembly. The second set configuration may include the use of hydraulic/fluid activation, and have nothing to do with the setting tool assembly.

Advantageously, a downhole tool embodiment of the present disclosure may be akin to a plug/ball, and may—but not required to—seat on the next lower profile sub in the wellbore. The interface geometry between the cone/expansion sleeve/ring may be configured to allow expansion to the desired outer diameter while staying within the operational force output of the setting tool (e.g., 55,000 lbf. for the size 20 tool).

In operation, with setting the tool, the tension mandrel may translate axially (uphole), which may shift the expansion ring and lower sleeve. As the expandable sleeve ring shifts it may make contact with the bearing ring and urge it outward to break at the predetermined location. The timing of this break is not fixed and may in some cases either be run in as an open c-ring or not break until later in the sequence.

Embodiments herein may include a system or method of using any downhole tool of the disclosure. For example, there may be a method of using the downhole tool, such as in a wellbore. The method may include running the downhole tool into the wellbore. The method may include using a mechanical device such as a setting tool assembly to move the downhole tool from a run-in configuration to a first set configuration.

The method may include disconnecting the mechanical device from (mechanical) connection with the downhole tool. Then, after the disconnecting step, the method may include using boost or other comparable fluid pressure to move the downhole tool from the first set configuration to a second or final set configuration.

In at least one of the first or second set configuration at least part of the downhole tool may be engaged with a surrounding tubular. In aspects, a profile surface of the surrounding tubular may be used to move (or facilitate moving) the downhole tool from the first set configuration to the second set configuration.

The method may include in the run-in configuration at least one component of the downhole tool may have a smaller OD than a drift ID (e.g., as defined per API 5CT) of a surrounding tubular. When the downhole tool is moved to another configuration from that of the run-in configuration, the sleeve may now have an OD larger than one or more profile IDs of the surrounding tubular.

Advantages

Embodiments herein may provide for a dissolvable plug and casing collar seat system that may utilize a collar seat or other profile size/shape that is at drift ID or larger.

Embodiments of the downhole tool are smaller in size, which allows the tool to be used in slimmer bore diameters. Smaller in size also means there is a lower material cost per tool. Because isolation tools, such as plugs, are used in vast numbers, and are generally not reusable, a small cost savings per tool results in enormous annual capital cost savings.

When downhole operations run about $30,000-$40,000 per hour, a savings measured in minutes (albeit repeated in scale) is of significance.

A synergistic effect is realized because a smaller tool means faster drilling time is easily achieved. Again, even a small savings in drill-through time per single tool results in an enormous savings on an annual basis.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool for use in a wellbore, the downhole tool comprising:

a cone comprising:

a distal end; a proximate end; and an outer surface, an expansion sleeve slidingly engaged with the outer surface;

a bearing ring adjacent the expansion sleeve in a run-in configuration; and a lower sleeve, wherein the expansion sleeve is configured to expand from a first sleeve outer diameter to a second sleeve outer diameter that is larger than the first sleeve outer diameter, wherein the bearing ring is configured with a failure point to facilitate fracture of the bearing ring at the fracture point, wherein the outer surface comprises: a first planar portion having a first outer cone diameter, a second planar portion having a second outer cone diameter, and a third planar portion having a third outer cone diameter, wherein at least one of the first planar portion, the second planar portion, and the third planar portion has a planar surface reference axis in longitudinal cross-section in parallel to a central longitudinal axis of the downhole tool, wherein the second outer cone diameter is larger than the first outer cone diameter, and the third outer cone diameter is larger than the second outer cone diameter, and wherein in the run-in configuration the expansion sleeve is directly engaged with the first planar portion, and in a first set configuration the expansion sleeve is not directly engaged with the first planar portion.

2. The downhole tool of claim 1, wherein at least one component of the downhole tool is made of a dissolvable material.

3. The downhole tool of claim 1, wherein during operation of the downhole tool in the wellbore, when the downhole tool is in the run-in configuration the cone is not directly engaged with the lower sleeve, but after setting the downhole tool to a first set configuration, the cone is directly engaged with the lower sleeve, and wherein the expansion sleeve has the first sleeve outer diameter in the run-in configuration.

4. The downhole tool of claim 3, wherein in the run-in configuration the expansion sleeve is engaged with the lower sleeve, but after setting the downhole tool to a final set configuration, the expansion sleeve is not engaged with the lower sleeve.

5. The downhole tool of claim 4, wherein in the final set configuration the bearing ring is fractured, but the expansion sleeve is not.

6. The downhole tool of claim 3, wherein at least one component of the downhole tool is made of a dissolvable material.

7. The downhole tool of claim 3, wherein in the first set configuration the expansion sleeve is directly engaged with the second planar portion.

8. The downhole tool of claim 7, wherein the cone further comprises a ball seat formed within an inner flowbore.

9. The downhole tool of claim 1, wherein during operation of the downhole tool in the wellbore, when the downhole tool is in the run-in configuration the cone is not directly engaged with the lower sleeve, but after setting the downhole tool to a first set configuration, the cone is directly engaged with the lower sleeve.

10. A downhole tool for use in a wellbore, the downhole tool comprising:

a cone comprising:

a distal end; a proximate end; an inner flowbore; a ball seat; and an outer surface, a bearing ring configured with a pre-determined failure point;

an expansion sleeve slidingly engaged with the outer surface; and a lower sleeve proximate with the expansion sleeve in a run-in configuration, wherein in the run-in configuration the cone is not directly engaged with the lower sleeve, but after setting the downhole tool to a first set configuration, the cone is directly engaged with the lower sleeve, wherein the expansion sleeve has a first sleeve outer diameter in the run-in configuration, and a second sleeve outer diameter in the first set configuration, wherein in at least one of the first set configuration or a final set configuration, the pre-determined failure point is broken, wherein the outer surface comprises: a first planar portion having a first outer cone diameter, a second planar portion having a second outer cone diameter, and a third planar portion having a third outer cone diameter, and wherein in the run-in configuration the expansion sleeve is directly engaged with the first planar portion, and in the first set configuration the expansion sleeve is not directly engaged with the first planar portion.

11. The downhole tool of claim 10, wherein at least one component of the downhole tool is made of a dissolvable material.

12. The downhole tool of claim 10, wherein in the final set configuration the expansion sleeve is expanded to an expansion diameter larger than the first sleeve outer diameter, but the expansion sleeve is not fractured.

13. The downhole tool of claim 10, wherein in the run-in configuration the expansion sleeve is engaged with the lower sleeve, but after setting the downhole tool to the final set configuration, the expansion sleeve is not engaged with the lower sleeve.

14. The downhole tool of claim 13, wherein the second outer cone diameter is larger than the first outer cone diameter, and the third outer cone diameter is larger than the second outer cone diameter.

15. A downhole setting system for use in a wellbore, the system comprising:

a workstring;

a setting tool assembly coupled to the workstring, the setting tool assembly further comprising:

a tension mandrel comprising a first tension mandrel end and a second tension mandrel end; and a setting sleeve;

a downhole tool comprising:

a cone comprising:

a distal end; a proximate end; and an outer surface, a bearing ring disposed around the cone;

an expansion sleeve disposed around the cone, and engaged with the outer surface; and a lower sleeve, wherein the outer surface comprises: a first planar portion having a first outer cone diameter, a second planar portion having a second outer cone diameter, and a third planar portion having a third outer cone diameter, wherein at least one of the first planar portion, the second planar portion, and the third planar portion has a planar surface reference axis in longitudinal cross-section in parallel to a central longitudinal axis of the downhole tool, wherein the second outer cone diameter is larger than the first outer cone diameter, and the third outer cone diameter is larger than the second outer cone diameter, wherein in a run-in configuration the lower sleeve is proximate the expansion sleeve, and also coupled with the tension mandrel, wherein the tension mandrel is disposed through the downhole tool in the run-in configuration, and wherein at least one component of the downhole tool is made of a dissolvable material.

16. The downhole setting system of claim 15, wherein activation of the downhole tool from the run-in configuration to a set configuration results in expansion, but not fracture, of the expansion sleeve, and also results in fracture of the bearing ring.

17. The downhole setting system of claim 15, the system further comprising a tubular disposed in the wellbore, wherein the tubular comprises a profile, the profile having a profile inner diameter, and wherein a side inner diameter of the tubular is larger than the profile inner diameter.

18. The downhole setting system of claim 17, wherein the setting tool is used to move the downhole tool from the run-in configuration to a first set configuration, and wherein the setting tool is not used to move the downhole tool from the first set configuration to a second set configuration.

19. The downhole setting system of claim 18, wherein in the run-in configuration the expansion sleeve has a first sleeve outer diameter, wherein in the first set configuration the expansion sleeve as a second sleeve outer diameter, and wherein the second sleeve outer diameter is greater than the first sleeve outer diameter.

20. The downhole setting system of claim 15, wherein in the run-in configuration the expansion sleeve is engaged with the lower sleeve, but after setting the downhole tool to the final set configuration, the expansion sleeve is not engaged with the lower sleeve.

* * * * *